US006861999B2

(12) United States Patent
Suga

(10) Patent No.: US 6,861,999 B2
(45) Date of Patent: Mar. 1, 2005

(54) CONVERTER STRUCTURE FOR USE IN UNIVERSAL LNB

(75) Inventor: Hiroyuki Suga, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/390,694

(22) Filed: Mar. 19, 2003

(65) Prior Publication Data

US 2003/0218574 A1 Nov. 27, 2003

(30) Foreign Application Priority Data

Mar. 19, 2002 (JP) ..... 2002-076553

(51) Int. Cl.[7] ..... H01Q 13/00; H01Q 19/00
(52) U.S. Cl. ..... 343/786; 343/756
(58) Field of Search ..... 343/786, 756, 343/909, 912; 333/21 A, 132, 137, 21 R; H01Q 13/00, 19/00

(56) References Cited

U.S. PATENT DOCUMENTS

2002/0179140 A1 * 12/2002 Toyomura ..... 136/251
2003/0058183 A1 * 3/2003 Nakagawa et al. ..... 343/786

FOREIGN PATENT DOCUMENTS

JP 3-76305 A 4/1991 ..... H01Q/21/06

* cited by examiner

*Primary Examiner*—Don Wong
*Assistant Examiner*—Trinh Vo Dinh
(74) *Attorney, Agent, or Firm*—Birch, Stewart, Kolasch & Birch, LLP.

(57) ABSTRACT

A converter main body is formed from composite material wherein reinforcing material comprising carbon fiber is combined with plastic material comprising ABS resin in an amount that is 30 wt % thereof. The coefficient of linear expansion of that composite material is made to be less than or equal to the coefficient of linear expansion of aluminum die cast alloy.

2 Claims, 12 Drawing Sheets

| Product number | ADC-12 | |
|---|---|---|
| Base material | Aluminum | |
| Reinforcing material (percentage content) | | |
| Sample No. | | |
| Ambient temperature [°C] | Local frequency [GHz] | Local drift [kHz] |
| Initial value 20 | 11.199760 | |
| -40 | 11.198762 | -998 |
| -30 | 11.199166 | -594 |
| -20 | 11.199270 | -490 |
| -10 | 11.199408 | -352 |
| 0 | 11.199584 | -176 |
| 10 | 11.199685 | -75 |
| 20 | 11.199835 | 75 |
| 30 | 11.199930 | 170 |
| 40 | 11.200030 | 270 |
| 50 | 11.200210 | 450 |
| 60 | 11.200285 | 525 |
| 70 | 11.200854 | 824 |

Fig.10

| Product number | 3001M | | | |
|---|---|---|---|---|
| Base material | ABS | | | |
| Reinforcing material (percentage content) | | | | |
| Sample No. | No. 1 | | No. 2 | |
| Ambient temperature [°C] | Local frequency [GHz] | Local drift [kHz] | Local frequency [GHz] | Local drift [kHz] |
| Initial value 20 | 11.201610 | | 11.202027 | |
| -40 | 11.207891 | 6281 | 11.209167 | 7140 |
| -30 | 11.207284 | 5674 | 11.208644 | 6617 |
| -20 | 11.206128 | 4518 | 11.207401 | 5374 |
| -10 | 11.205117 | 3507 | 11.206261 | 4234 |
| 0 | 11.203963 | 2353 | 11.204943 | 2916 |
| 10 | 11.202780 | 1170 | 11.203457 | 1430 |
| 20 | 11.201429 | -181 | 11.201915 | -112 |
| 30 | 11.200159 | -1451 | 11.200372 | -1655 |
| 40 | 11.198906 | -2704 | 11.198805 | -3222 |
| 50 | 11.197518 | -4092 | 11.197041 | -4986 |
| 60 | 11.195837 | -5773 | 11.195026 | -7001 |
| 70 | 11.193475 | -8135 | 11.192408 | -9619 |

Fig.12

| Product number | ABS-CF30 | | | |
|---|---|---|---|---|
| Base material | ABS | | | |
| Reinforcing material (percentage content) | CF(30%) | | | |
| Sample No. | No. 3 | | No. 4 | |
| Ambient temperature [°C] | Local frequency [GHz] | Local drift [kHz] | Local frequency [GHz] | Local drift [kHz] |
| Initial value 20 | 11.200555 | | 11.200552 | |
| -40 | 11.201485 | 930 | 11.201746 | 1194 |
| -30 | 11.201489 | 934 | 11.201758 | 1206 |
| -20 | 11.201445 | 890 | 11.201599 | 1047 |
| -10 | 11.201395 | 840 | 11.201531 | 979 |
| 0 | 11.201305 | 750 | 11.201379 | 827 |
| 10 | 11.201129 | 574 | 11.201227 | 675 |
| 20 | 11.200854 | 299 | 11.200872 | 320 |
| 30 | 11.200533 | -22 | 11.200640 | 88 |
| 40 | 11.200477 | -78 | 11.200599 | 47 |
| 50 | 11.200314 | -241 | 11.200531 | -21 |
| 60 | 11.199882 | -673 | 11.200064 | -488 |
| 70 | 11.198704 | -1851 | 11.198934 | -1618 |

CONVERTER STRUCTURE FOR USE IN UNIVERSAL LNB

BACKGROUND OF INVENTION

1. Field of Invention

The present invention relates to a converter structure for use in a receiving converter which is capable of receiving electromagnetic waves sent from a broadcast satellite or communication satellite and converting same to a first intermediate frequency signal that is output to a tuner circuit in a stage downstream therefrom, and more particularly relates to a converter structure for use in a universal LNB, universal LNBs being known as LNB converters.

2. Conventional Art

Dissemination of satellite broadcast capability to ordinary households has begun to accelerate in recent years, this representing a trend which can be observed worldwide. In accompaniment hereto, various types of receiving converters capable of being used together with antennas for receiving satellite broadcasts have been proposed, recent receiving converters—which include LNBs (Low Noise Blockdown Converters) capable of receiving frequencies over wide bands, LNBs for receiving both horizontally and vertically polarized waves, LNBs for receiving both dextrorotatorily and levorotatorily polarized waves, and so forth—exhibiting a trend toward increased number of terminals. Such general-purpose LNB converters are called "universal LNBs."

The trend toward increased use of satellite broadcasts in various countries will now be described. Analog broadcasts via the Astra satellites (1A/1B/1C) had occupied the central role in the European market. Then, with the launching of the Astra 1D in 1994, digital broadcasts were initiated on an experimental basis in January of 1995. With the further launching of Astra 1E in October of 1995, and Astra 1F sometime around the end of 1995, a serious digital broadcast market is on its way to being established. Including both direct reception and indirect reception, receiving subscribers in Europe numbered approximately 57,000,000 homes at the end of 1994. Given such circumstances and in light of the advent of the start of digital broadcasting, increased LNB bandwidth and improved LNB stability are desired for accommodation of the two frequency bands.

Furthermore, in the U.S. market, serious digital broadcasts began around mid-1994, with subscribers increasing at a rate of one million and several hundreds of thousands of homes per month, and looking to the future it appears that several companies will be launching new digital broadcast satellites. Given such circumstances, there is also demand in the U.S. market for increased LNB bandwidth, improved LNB stability, and reduction in LNB cost. Turning to the Japanese market, digital broadcasts using JCSAT began around the spring of 1996. Moreover, digital broadcasts using Superbird began in the first half of 1997. In accompaniment to such technological trends, there is in fact ever-increasing demand for an LNB capable of receiving both digital broadcasts via CS as well as BS broadcasts.

Now, as shown in FIGS. 14 and 15, conventionally known as such a converter is a device equipped with a roughly rectangular chassis 93 to which there are secured at one side thereof (the bottom side in FIGS. 14 and 15) a terminal block 92 comprising cylindrical external conductors 90 within which central conductors are installed, and a planar block base member 91 on which a plurality of these external conductors 90 are co-mounted; a plurality of circular waveguides 94, . . . mounted so as to jut out from the other side of this chassis 93 (the top side in FIGS. 14 and 15); cap-like feedhorns 95, . . . respectively joined to the distal ends of these circular waveguides 94; rectangular waveguides 96, joined to the basal ends (located in a direction opposite feedhorns 95 from chassis 93) of the respective circular waveguides 94 and extending therefrom in a more or less perpendicular direction (in the direction of the terminal block 92), being attached thereto so as to straddle microstrip circuit boards (not shown) between themselves and prescribed locations on the circular waveguides 94; and a back cover 97 covering this chassis 93 so as to cover these rectangular waveguides 96 and the microstrip circuit boards from the back (the rectangular waveguide 96 side) thereof. Furthermore, the aforesaid circular waveguides 94, rectangular waveguides 96, chassis 93, and back cover 97 are formed from aluminum die cast alloy, the microstrip circuit boards being shielded from unwanted radiation signals and the like. Here, as shown in FIG. 16, the converter A is attached to an antenna 99 by means of an arm 98.

However, in the aforesaid conventional converter A, because the converter main body—which constitutes circular waveguides 94, rectangular waveguides 96, chassis 93, and back cover 97—is formed entirely from aluminum die cast alloy, the weight thereof is considerable. This causes the attachment procedure by which the converter A is attached to the antenna 99 to be made complicated. Moreover, considering the deformation which arm region 98 could suffer in the event of a typhoon or strong winds, arm region 98 must be reinforced with reinforcing material 89 or the like to ensure long-term reliability, this point representing a problem from the standpoint of increased materials cost.

SUMMARY OF INVENTION

The present invention was conceived in light of such issues, it being an object thereof to provide a converter structure for use in a universal LNB which permits achievement of reduction in materials cost and simplification of converter attachment procedures.

In order to achieve the foregoing object, the present invention is such that in a converter structure for use in a universal LNB, which converter structure is such that secured to one or more surfaces at one end of a converter main body there are one or more terminal blocks comprising one or more cylindrical external conductors within which one or more central conductors are installed, and one or more planar block base members on which a plurality of these external conductors are co-mounted, the converter main body is formed from composite material wherein reinforcing material comprising carbon fiber is combined with plastic material comprising ABS resin.

Because such specific features permit a converter main body to be formed from composite material wherein reinforcing material is combined with plastic material, lightness in weight is achieved as compared with the situation where a converter main body is formed from aluminum die cast alloy. This therefore makes it possible for the converter attachment procedure by which converter(s) is or are attached to antenna(s) to be easily carried out. Furthermore, reliability being ensured over long periods without any need to reinforce arm(s) with reinforcing material(s) or the like, it is possible to reduce costs related to materials that would have been necessary for reinforcement.

In particular, if reinforcing material is combined with plastic material in an amount that is 30 wt % thereof and the coefficient of linear expansion of that composite material is made to be less than or equal to the coefficient of linear expansion of aluminum die cast alloy, frequency drift due to variation in temperature, which represents a fundamental property thereof, can be held to ±2 MHz or less, a value not inferior to that for the fundamental frequency of a converter made from aluminum die cast alloy, permitting attainment of properties interchangeable with converters made from aluminum die cast alloy.

BRIEF DESCRIPTION OF DRAWINGS

FIG. 10 is a characteristics chart showing characteristics of local frequency thermal drift data for a converter main body made from general-purpose plastic material.

FIG. 12 is a characteristics graph showing characteristics of local frequency thermal drift data for a converter main body made from composite material wherein reinforcing material is combined with plastic material in an amount that is 30 wt % thereof.

DESCRIPTION OF PREFERRED EMBODIMENTS

Below, embodiments of the present invention are described with reference to the drawings.

Figure 1:
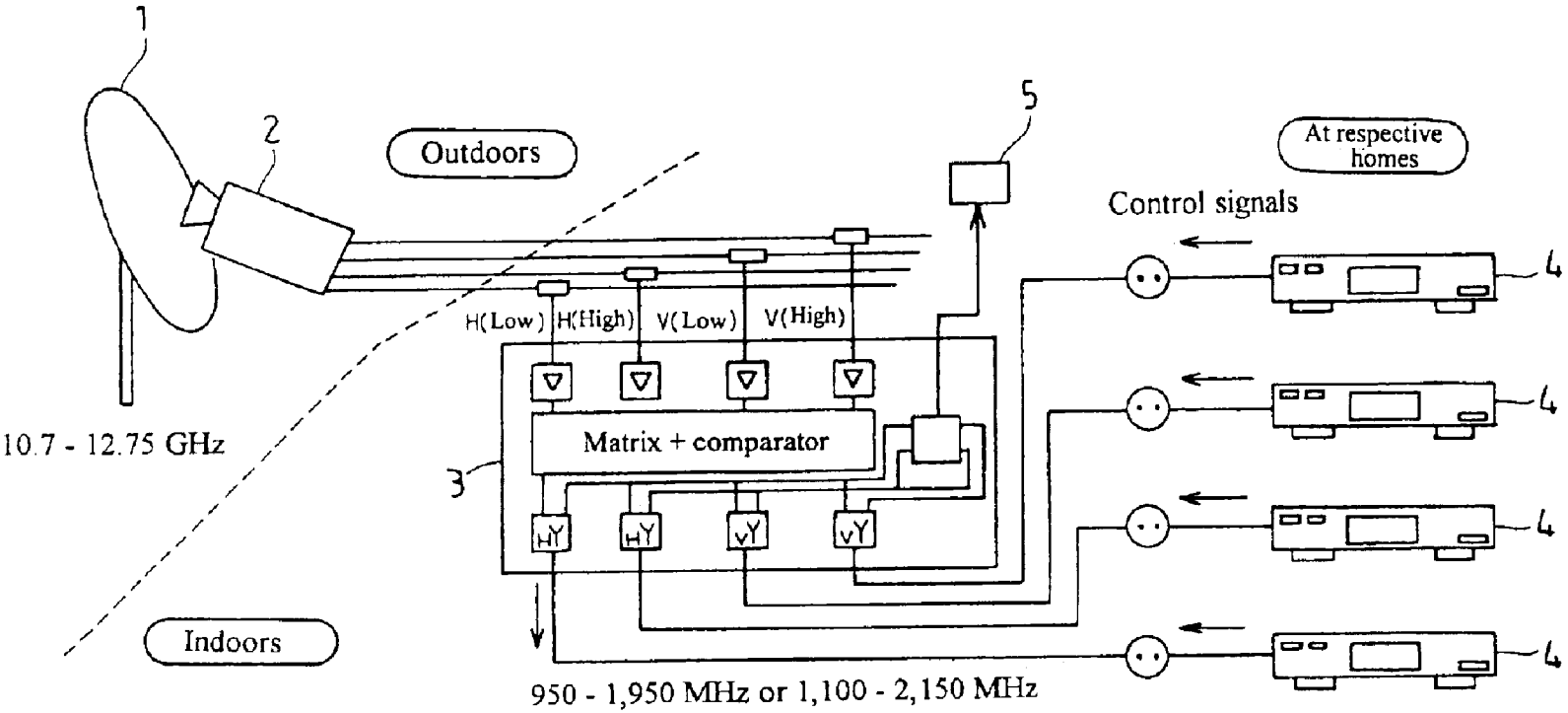
FIG. 1 is a schematic diagram showing an example of a satellite broadcast receiving system employing a converter for use in a universal LNB which is associated with an embodiment of the present invention.

First shown at FIG. 1 is a schematic diagram of an example of a system employing a converter for use in a universal LNB to which the present invention is directed.

Same diagram illustrates in schematic fashion an indirect shared receiving system of the SMATV (Satellite Master Antenna TV) variety wherein H (low), H (high), V (low), and V (high) terminals 61 (see FIG. 2) serving as external conductors at converter 2 which is disposed opposite parabola antenna 1, located outdoors, are respectively connected by way of control box (housing a matrix+comparator) 3, located indoors, to digital receivers 4, . . . in respective homes, switching between low-band and high-band reception being carried out by means of control signals from the respective digital receivers 4. Note that at the foregoing, H (low) at terminals 61 indicates the horizontally polarized low-band output signal, terminal H (high) indicates the horizontally polarized high-band output signal, terminal V (low) indicates the vertically polarized low-band output signal, and terminal V (high) indicates the vertically polarized high-band output signal. Note further that 5 represents a power supply.

Figure 2:
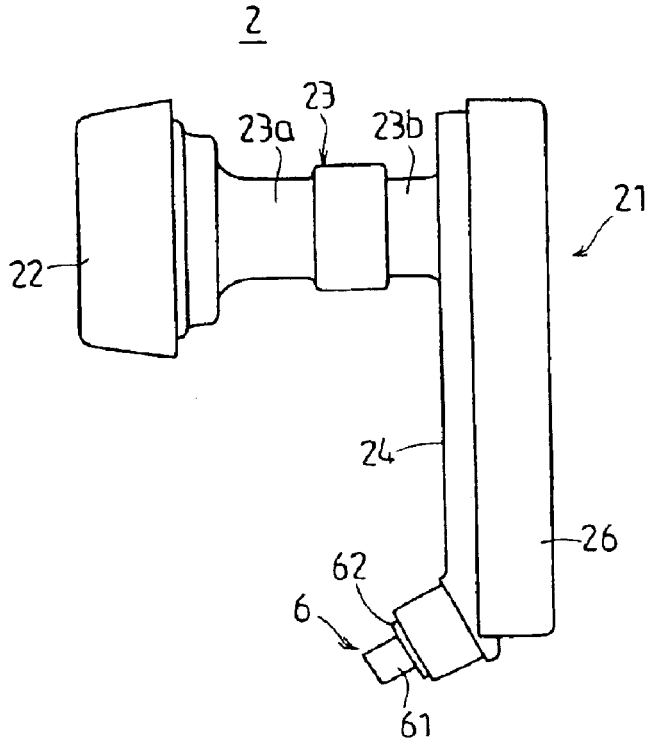
FIG. 2 is a front view of a converter which may be employed in the system shown in FIG. 1.
Figure 3:
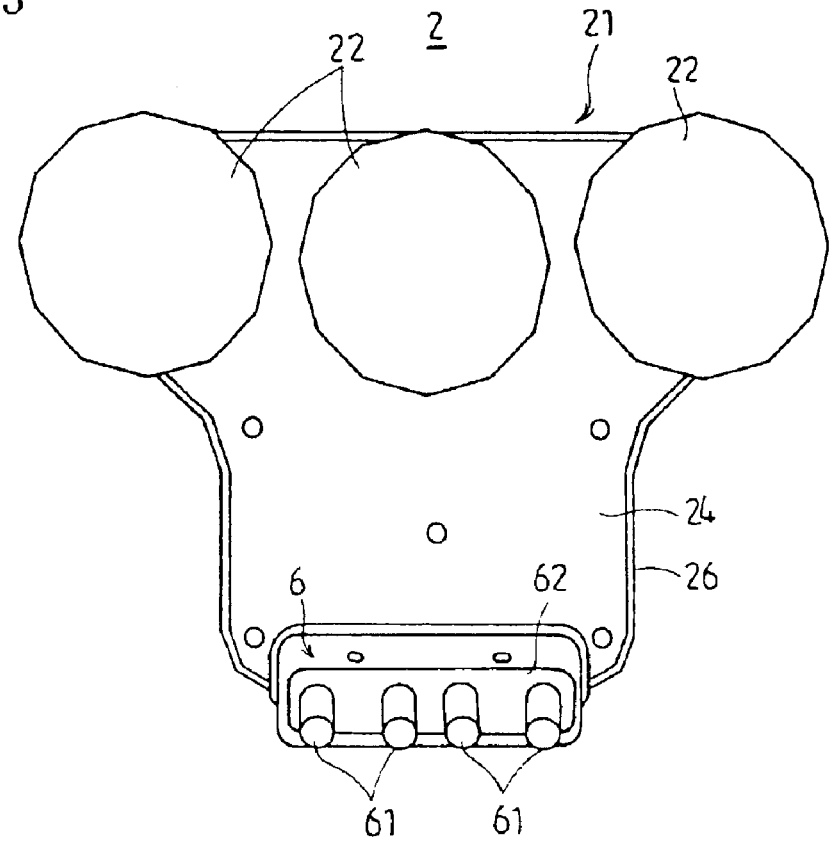
FIG. 3 is a side view of same converter.
Figure 4:
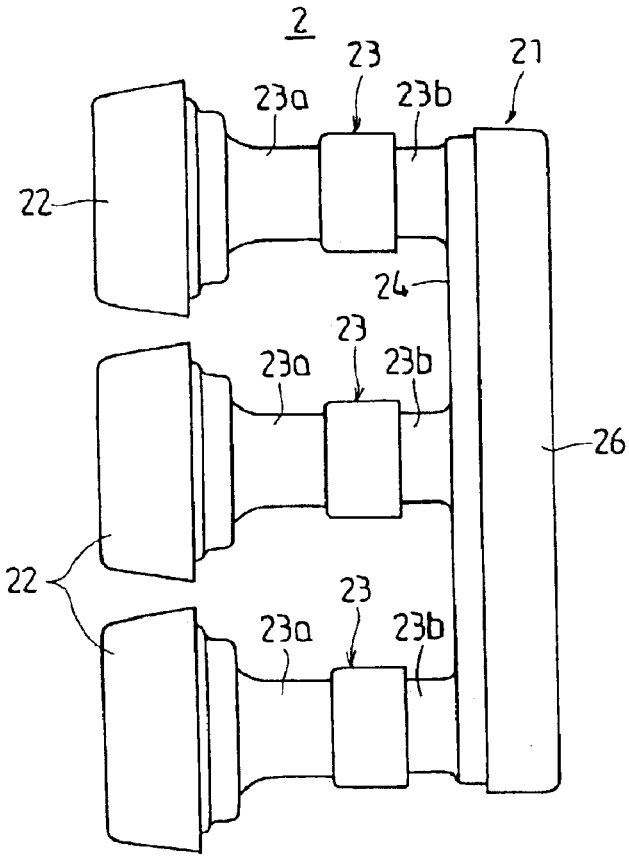
FIG. 4 is a plan view of same converter.

Furthermore, FIGS. 2 through 4 respectively show a front view, side view, and plan view of a converter 2 which may be employed in the foregoing system. FIGS. 2 through 4 show an example of a four-output-type converter 2, the converter main body 21 being constructed so as to have a plurality of terminals 61 at one side thereof (the bottom side in FIGS. 2 and 3), and so as to have circular waveguides 23 equipped with a plurality of feedhorn(s) 22 at another side thereof (the top side in FIGS. 2 and 3).

Figure 5:
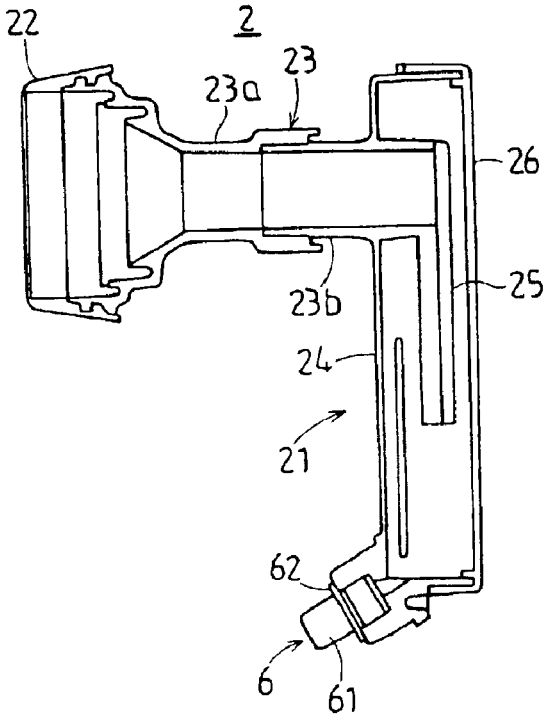
FIG. 5 is a sectional front view of same converter.
Figure 6:
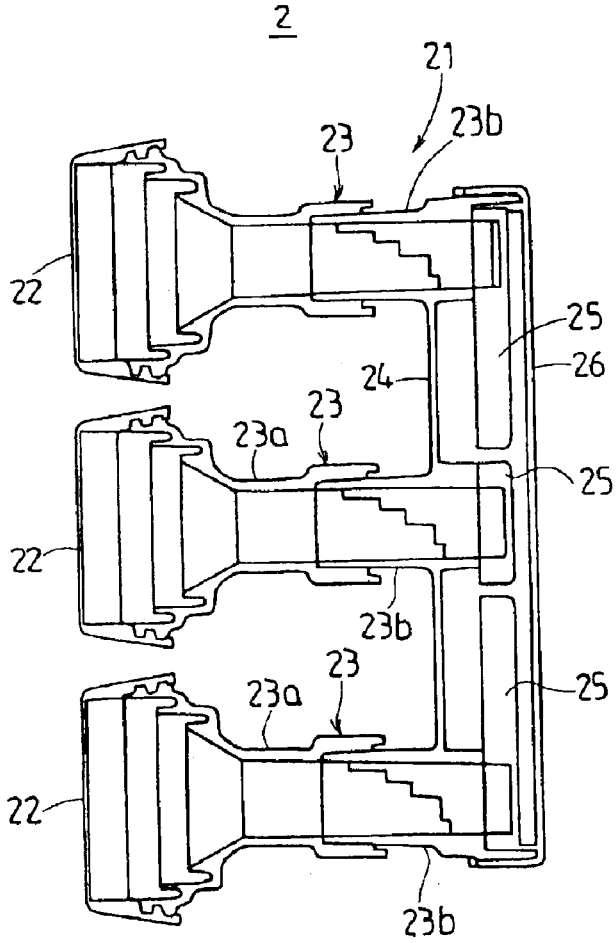
FIG. 6 is a sectional plan view of same converter.

FIG. 5 and FIG. 6 show a sectional front view and a sectional plan view of converter 2. Provided at FIGS. 5 and 6 are a roughly rectangular chassis 24 to which there are secured at one end thereof (the bottom end in FIG. 5) a terminal block 6 comprising cylindrical terminals 61 within which central conductors are installed, and a planar block base member 62 on which four of these terminals 61 are co-mounted; a plurality of circular waveguides 23, . . . mounted so as to jut out from another side of this chassis 24 (the top side in FIG. 5); cap-like feedhorns 22, . . . respectively attached to the distal ends of these circular waveguides 23; rectangular waveguides 25, joined to the basal ends (located in a direction opposite feedhorns 22 from chassis 24) of the respective circular waveguides 23 and extending therefrom in a more or less perpendicular direction, being attached thereto so as to straddle microstrip circuit boards (not shown) between themselves and prescribed locations on the circular waveguides 23; and a back cover 26 which covers these rectangular waveguides 25 and the microstrip circuit boards from the back (the rectangular waveguide 25 side) of the chassis 24. The circular waveguides 23 comprise horn-side regions 23*a* at the distal ends thereof, and chassis-side regions 23*b* at the basal ends thereof, the respective-side regions being mutually engaged.

Figure 7:
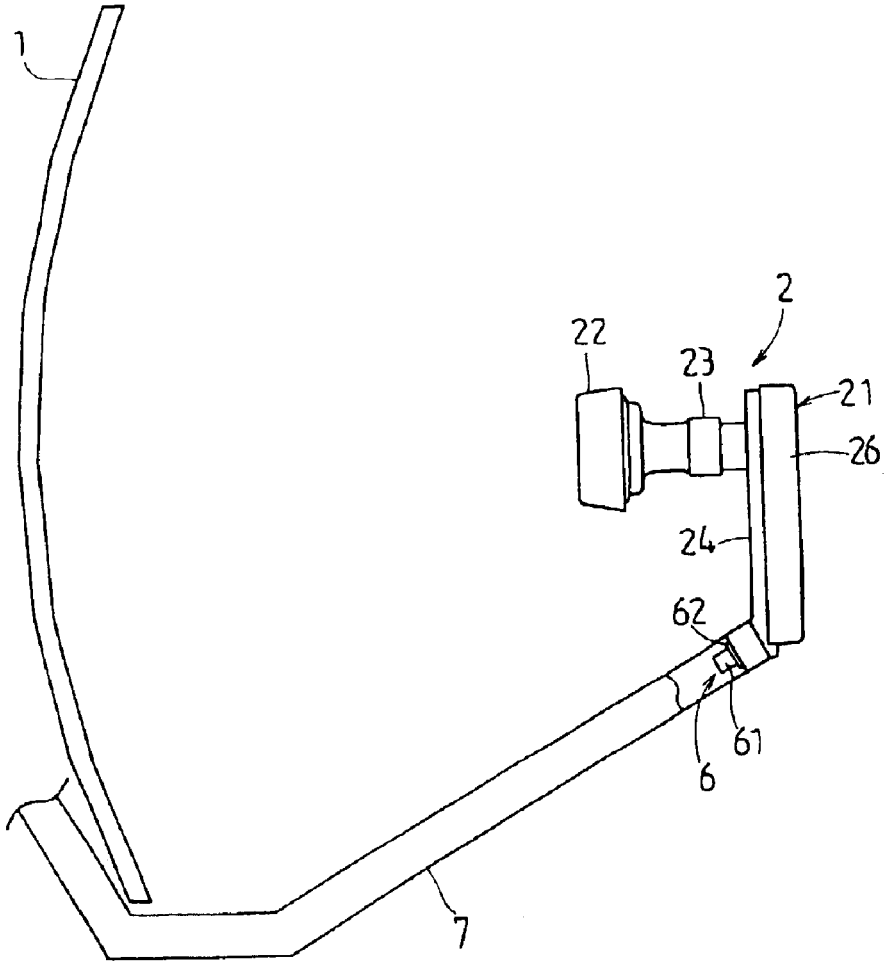
FIG. 7 is a drawing showing attachment of same converter to a parabola antenna.

As shown in FIG. 7, the converter 2 is attached to parabola antenna 1 by way of arm 7. The arm 7 is formed from plastic material comprising ABS resin, one end thereof being attached to one side of converter main body 21 so as to cover respective terminals 61 of converter 2, and the other end thereof being attached to a support member (not shown) of parabola antenna 1.

Furthermore, the feedhorns 22, circular waveguides 23 (horn-side regions 23*a* and chassis-side regions 23*b*), chassis 24, rectangular waveguide 25, and back cover 26 which make up the converter main body 21 are formed from composite material wherein reinforcing material comprising carbon fiber is combined with plastic material comprising ABS resin in an amount that is 30 wt % thereof. Here, the coefficient of linear expansion of the composite material making up converter main body 21 is held to a value which is less than or equal to the coefficient of linear expansion of aluminum die cast alloy.

Next, using converter main body 21 of the present invention which is formed from composite material wherein reinforcing material (carbon fiber) is combined with plastic material (ABS resin) in an amount that is 30 wt % thereof, using a converter main body formed from aluminum die cast alloy, and using a converter main body formed from general-purpose plastic material (ABS resin) which has not been combined with reinforcing material (carbon fiber), differences in respective local frequency thermal drift data are described with reference to FIGS. 8 through 13.

The converter main body formed from aluminum die cast alloy is first described. The coefficient of linear expansion of this aluminum die cast alloy is $2.1\times10^{-5}$/K.

Figures 8, 9:
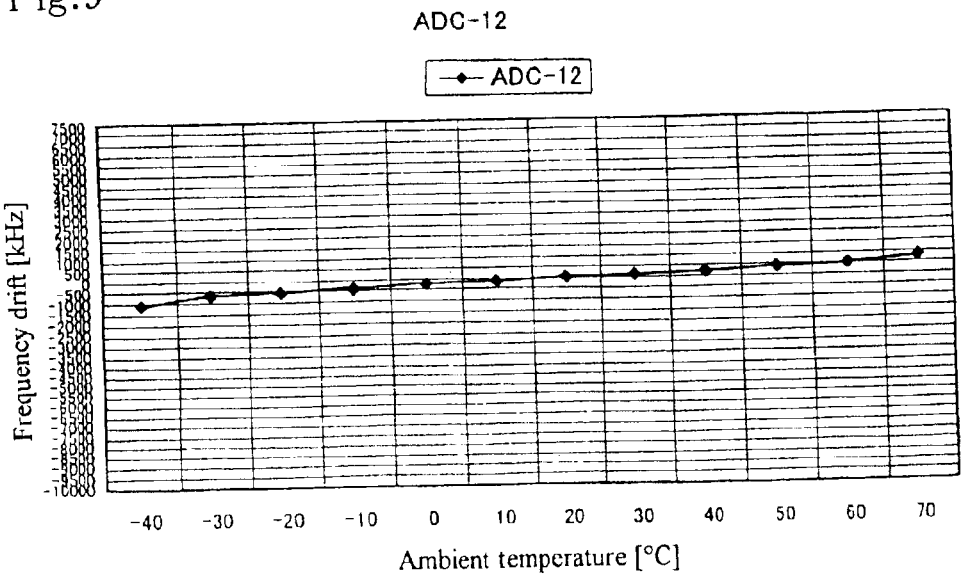
FIG. 8 is a characteristics chart showing characteristics of local frequency thermal drift data for a converter main body made from aluminum die cast alloy.
FIG. 9 is a characteristics graph showing characteristics of frequency drift versus ambient temperature for a converter main body made from aluminum die cast alloy.

As shown in FIGS. 8 and 9, with a converter main body made from aluminum die cast alloy, shift in local frequency due to thermal drift is less than or equal to ±2 MHz, and it is clear that shielding of the microstrip circuit boards from unwanted radiation signals and the like is permitted. Here, because the specific gravity of aluminum die cast alloy is 2.7 and the total weight of the converter main body formed therefrom is as heavy as approximately 860 gm, considering the deformation which the arm could suffer in the event of a typhoon or strong winds, the arm is reinforced with reinforcing material or the like to ensure reliability over an extended period.

Figure 11:
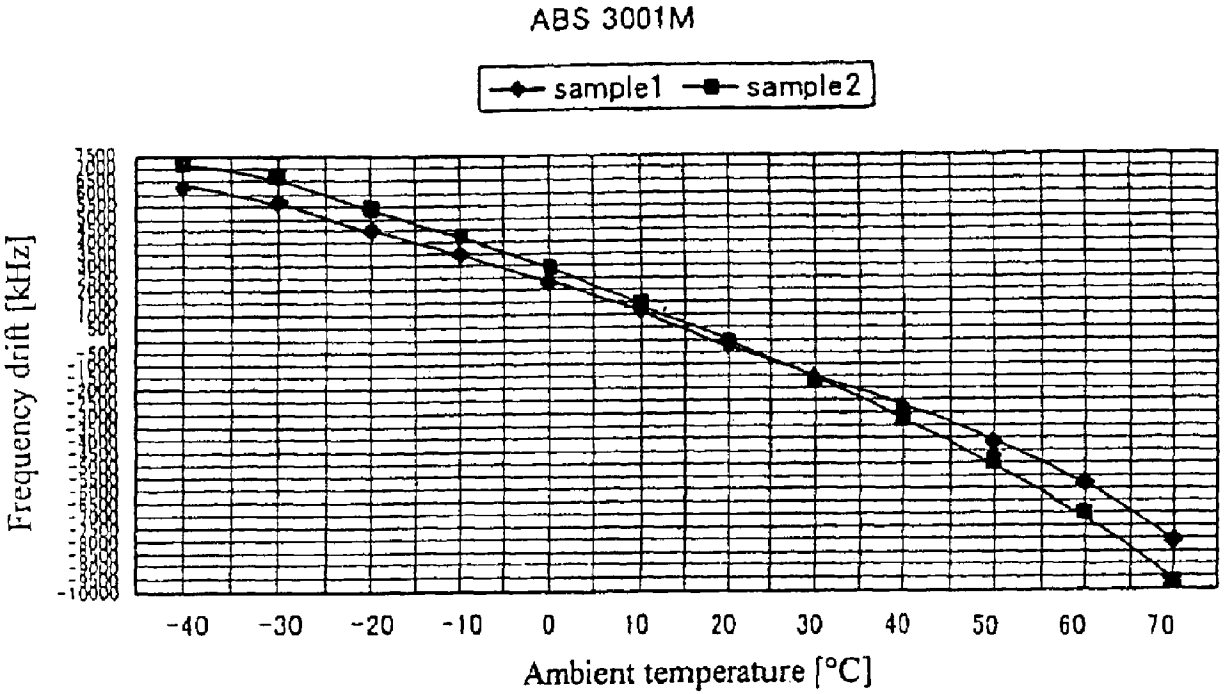
FIG. 11 is a characteristics graph showing characteristics of frequency drift versus ambient temperature for a converter main body made from general-purpose plastic material.

On the other hand, with a converter main body formed from general-purpose plastic material (ABS resin) which has not been combined with reinforcing material (carbon fiber), the coefficient of linear expansion of ABS resin is $1.4\times10^{-5}$/K, as shown in FIGS. 10 and 11 the shift in local frequency due to thermal drift is ±10 MHz, and it is clear that adequate shielding of the microstrip circuit boards from unwanted radiation signals and the like is not permitted. Here, while the specific gravity of ABS resin is 1.2 and the converter main body can be made extremely lightweight, because the shift in local frequency due to thermal drift is as large as ±10 MHz the fundamental properties required of a converter are not satisfied.

Figure 13:
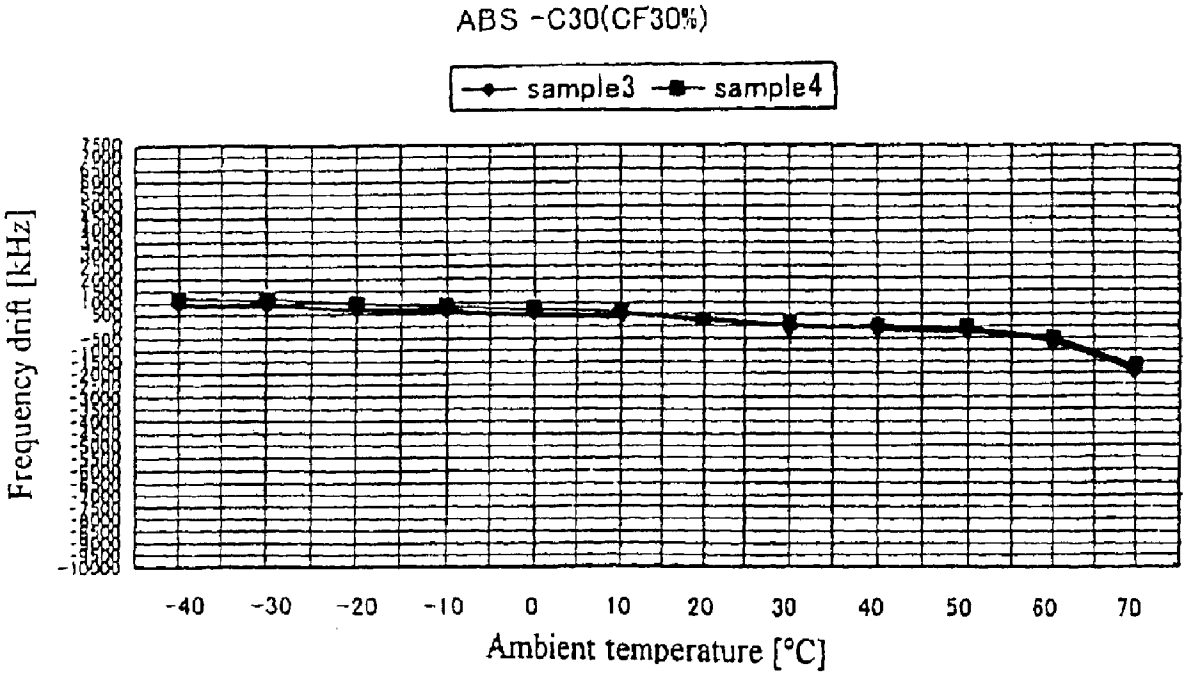
FIG. 13 is a characteristics chart showing characteristics of frequency drift versus ambient temperature for a converter main body made from composite material wherein reinforcing material is combined with plastic material in an amount that is 30 wt % thereof.
Figure 14:
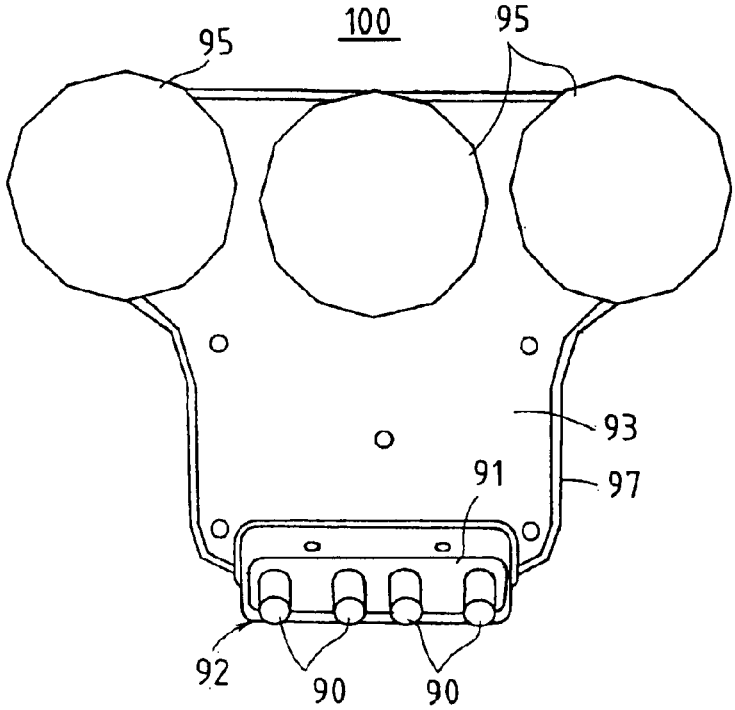
Fig.14 CONVENTIONAL ART
FIG. 14 is a side view of a converter associated with a conventional example.
Figure 15:
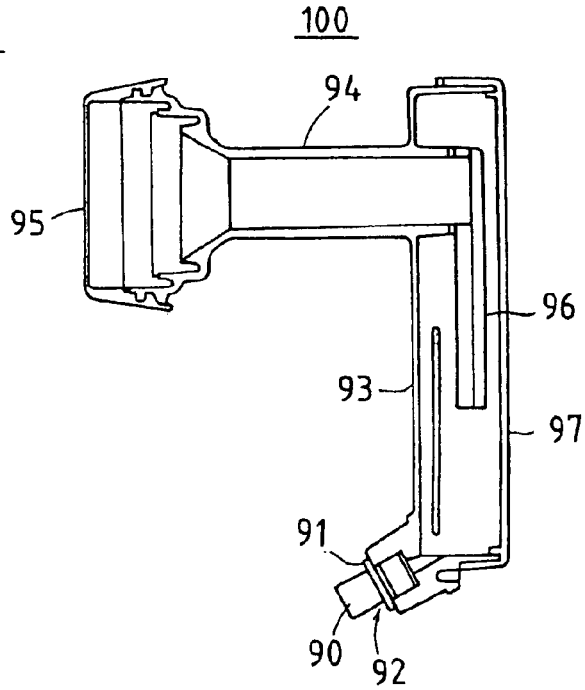
Fig.15 CONVENTIONAL ART
FIG. 15 is a sectional front view of same converter.
Figure 16:
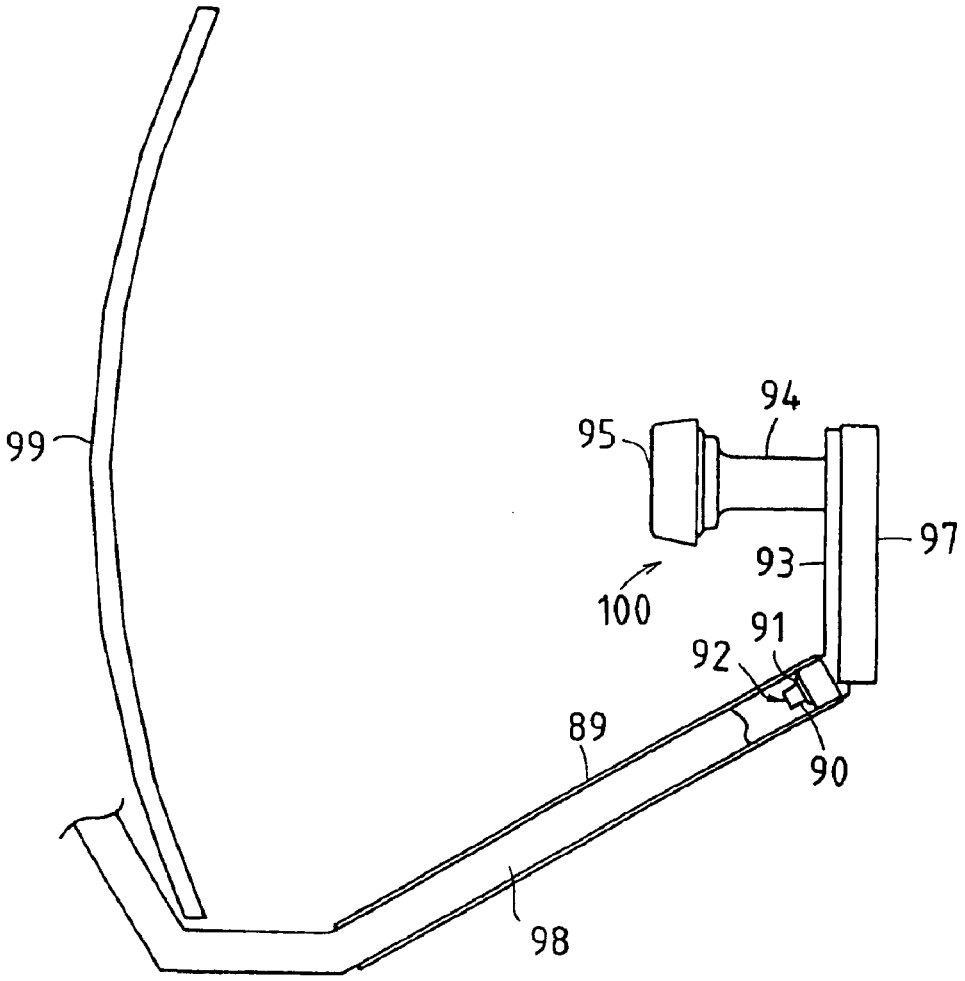
Fig.16 CONVENTIONAL ART
FIG. 16 is a drawing showing attachment of same converter to a parabola antenna.

Finally, with converter main body 21 of the present invention which is formed from composite material wherein reinforcing material (carbon fiber) is combined with plastic material (ABS resin) in an amount that is 30 wt % thereof, the coefficient of linear expansion of the composite material is lower than the coefficient of linear expansion of aluminum die cast alloy ($2.1\times10^{-5}$/K), and as shown in FIGS. 12 and 13 the shift in local frequency due to thermal drift is less than or equal to ±2 MHz.

Based on the foregoing, employment in the present embodiment of composite material wherein reinforcing material (carbon fiber) is combined with plastic material (ABS resin) in an amount that is 30 wt % thereof makes it possible for frequency drift due to variation in temperature, which represents a fundamental property thereof, to be held to ±2 MHz or less, a value not inferior to that for the fundamental frequency of a converter made from aluminum die cast alloy, permitting attainment of properties interchangeable with converters made from aluminum die cast alloy.

Furthermore, because the total weight of converter main body 21 is as light as approximately 750 gm, it is possible for the converter attachment procedure by which converter 2 is attached to parabola antenna 1 to be easily carried out. Moreover, assurance of reliability over long periods is made possible without any need to reinforce arm 7 with reinforcing material or the like, permitting reduction in costs related to materials that would have been necessary for reinforcement.

The present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are moreover within the scope of the present invention.

Moreover, the present application claims right of benefit of prior filing date of Japanese Patent Application No. 2002-076553, the content of which is incorporated herein by reference in its entirety. Furthermore, all references cited in the present specification are specifically incorporated herein by reference in their entirety.

What is claimed is:

1. A converter structure for use in a universal LNB, the converter structure comprising:

a main body including one or more terminal blocks secured to one or more surfaces at one end of the converter main body comprising one or more cylindrical external conductors including one or more central conductors are installed therein, and one or more planar block base members co-mounted with a plurality of the one or more cylindrical external conductors, wherein the converter main body is formed from composite material including a reinforcing material comprising carbon fiber combined with a plastic material comprising ABS resin.

2. The converter structure for use in a universal LNB according to claim 1, wherein the reinforcing material combined with the plastic material in an amount that is 30 wt %; and a coefficient of linear expansion of the composite material is less than or equal to the coefficient of linear expansion of aluminum die cast alloy.

* * * * *